United States Patent [19]

Prince

[11] Patent Number: 4,491,316

[45] Date of Patent: Jan. 1, 1985

[54] APPARATUS FOR PRACTICING DEFENSE ARTS

[76] Inventor: John B. Prince, 118 Tanglewood Loop, Mabank, Tex. 75147

[21] Appl. No.: 450,670

[22] Filed: Dec. 17, 1982

[51] Int. Cl.[3] ..... A63B 69/00

[52] U.S. Cl. ..... 272/78

[58] Field of Search ..... 272/76, 77, 78; 273/55 R, 55 A

[56] References Cited

U.S. PATENT DOCUMENTS

| | | | |
|---|---|---|---|
| 1,582,487 | 4/1926 | Shank | 272/78 UX |
| 1,928,089 | 9/1933 | Blickman | 272/78 |
| 3,365,947 | 1/1968 | Janich et al. | 273/55 R |
| 3,427,021 | 2/1969 | Donato | 272/76 |
| 3,897,060 | 7/1975 | Jennings | 273/55 R |

*Primary Examiner*—William H. Grieb

*Attorney, Agent, or Firm*—Hubbard, Thurman, Turner & Tucker

[57] ABSTRACT

An apparatus for practicing the defense arts such as karate including a frame having a vertical mast member on which a universal support bracket is mounted for supporting articles to be struck by the artisan. The support bracket provides a substantially clear span between portions of the article that are supported to minimize the risk of injury. Detachable target members are adapted for mounting on the universal support bracket and are provided with visual and/or audible indicators for measuring the accuracy and intensity of blows delivered to the target members.

19 Claims, 12 Drawing Figures

APPARATUS FOR PRACTICING DEFENSE ARTS

BACKGROUND OF THE INVENTION

1. Field of the Invention

The present invention pertains to an apparatus for supporting a target or an article to be used in practicing defense arts such as karate wherein the target or the article is struck by a swift blow delivered by the hand or foot, for example. The target is adapted to register the accuracy and severity of the blow and the structure for supporting an article to be broken is adapted to minimize the risk of injury upon delivering the blow to said article.

2. Background

The art of self-defense by delivering swift and deceptive blows using the hands, feet or other portions of human appendages requires development of the ability to deliver a blow accurately to a target located in various positions. Moreover, in the practice of the art of karate, for example, the demonstration of skill in the art includes the breaking of various articles such as panels of wood or masonry. In this regard it is desirable to be able to properly support the article to be struck so that adequate clearance around the supported article is provided and the risk of injury to the person delivering the blow is minimized.

In respect to the above noted needs and desiderata in practicing karate and similar defense arts there has been a longfelt desire to provide an apparatus which is adapted to position a target or an object to be struck in a wide range of positions for practicing various blow delivering maneuvers and kicks. There has further been a desire and need to provide apparatus which is adapted to measure the accuracy of placement of a blow delivered in self-defense as well as the intensity of the blow in order to improve the practitioner's skill in the practice of the art. It is to this end that the present invention has been developed.

SUMMARY OF THE INVENTION

The present invention provides an apparatus which is particularly adapted for practicing the defense arts such as karate and including means for supporting targets in various positions over a large target zone and means for measuring the accuracy and intensity of a blow delivered by the artist's hands or feet.

In accordance with one aspect of the present invention there is provided an apparatus which includes a support bracket for supporting a target or an article on which a blow is to be struck and wherein the bracket may be positioned over a wide target range to allow the artisan to practice delivering blows at targets located in various positions. The target or article supporting bracket is adapted for movement on a vertical support member or mast and includes universal positioning means for positioning a target or article to be struck in a wide range of positions and directional attitudes.

In accordance with another aspect of the present invention there is provided an apparatus which includes a support bracket adapted to support a plurality of different target devices for use in practicing a defense art such as karate or the like and wherein the target devices are readily interchangeable for practicing various types of blows and blow delivering maneuvers. A universal type support bracket has been devised in accordance with the present invention which is also adapted to provide a clear span between opposed supporting members so that various articles such as wood or masonry panels may be supported for receiving a blow delivered by the artisan's hand or foot to break the target while minimizing the risk of injury to the artisan from striking the support structure itself.

In accordance with yet a further aspect of the present invention there are provided interchangeable target devices or head members which are adapted to be supported by the support bracket of the apparatus of the invention and which are also adapted to include means for signalling the accuracy of placement of a blow on the target and/or the intensity of the blow to assist the artisan in developing blow delivering skills.

The apparatus of the present invention also includes unique structure for utilizing the apparatus as a portable unit or as a substantially stationary and fixed unit.

Those skilled in the art of the present invention will recognize and appreciate the features of the invention described hereinabove as well as other superior aspects of the invention upon reading the detailed description which follows in conjunction with the drawings.

DESCRIPTION OF THE PREFERRED EMBODIMENTS

Figure 1:
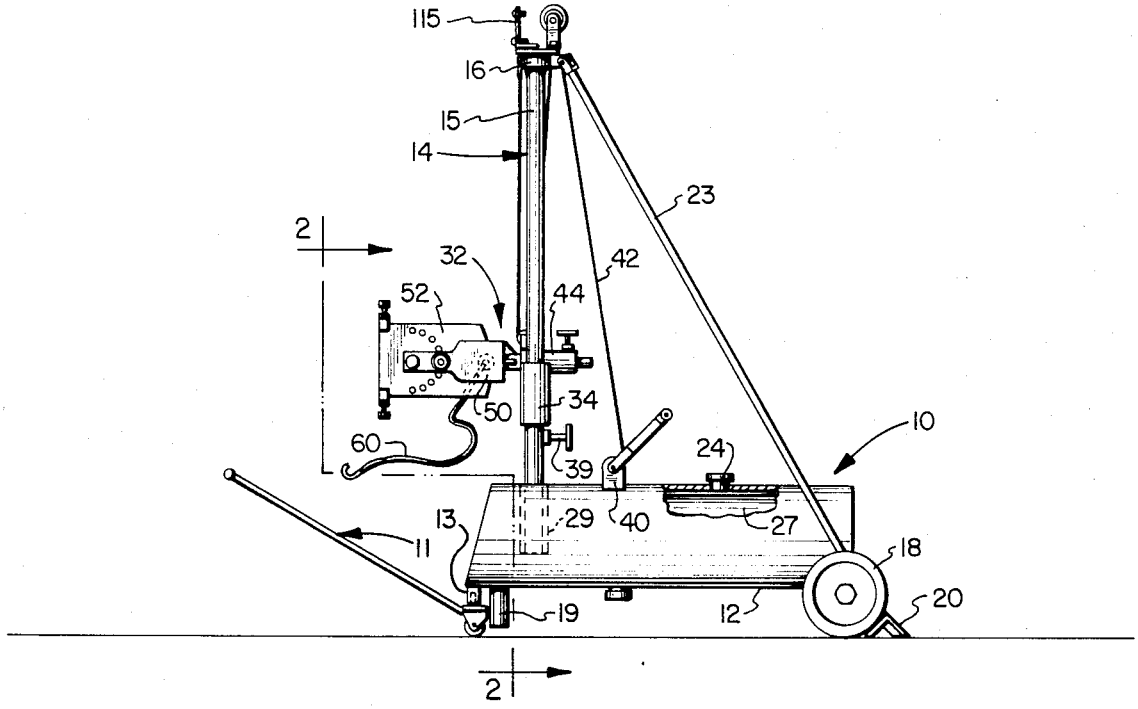
FIG. 1 is a side elevation of a portable apparatus for practicing defense arts in accordance with the present invention.

In the description which follows like parts are marked throughout the specification and drawings with the same reference numerals, respectively. The drawings are not necessarily to scale and certain features of the invention may be exaggerated in scale or shown in schematic form in order to better illustrate the inventive concept.

Figure 2:
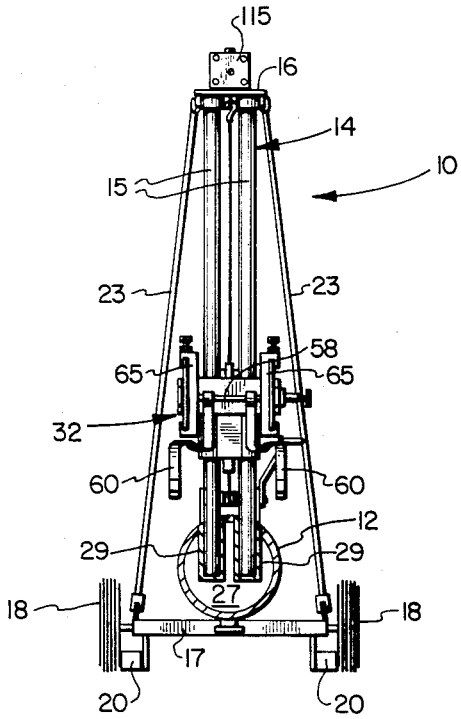
FIG. 2 is a view taken substantially along line 2—2 of FIG. 1.

Referring to FIGS. 1 and 2, there is illustrated an apparatus for use in practicing the defense arts, particularly the art of karate, which apparatus which is generally designated by the numeral 10. The apparatus 10 includes a frame comprising a substantially horizontally extending member 12 which is adapted to support an upstanding mast 14 comprising a pair of cylindrical tubular columns 15 which are supported by the member 12 and are held in assembly at their upper ends by a suitable cap member 16. The frame member 12 is suitably supported on a transverse axle member 17 having opposed wheels 18 suitably connected to opposite ends thereof. The opposite end of the frame member 12 includes two closely spaced apart downwardly depending support legs 19, one shown in FIG. 1. The frame member 12 further includes a downward depending member 13 forming a socket for receiving a coupling pin mounted on a hand dolly 11 whereby the apparatus 10 may be towed from one place to another.

Figure 3:
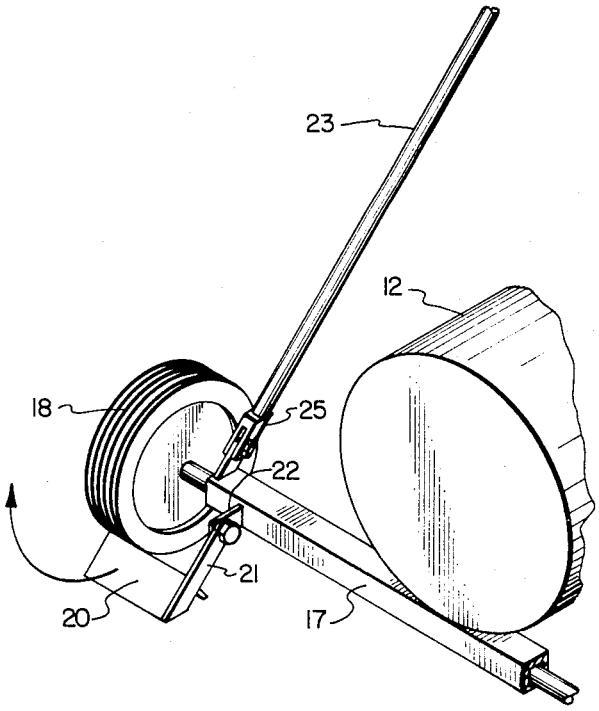
FIG. 3 is a detail view of a brake mechanism for use with the apparatus illustrated in FIG. 1.

Referring briefly to FIG. 3, the axle member 17 is adapted to support opposed wheel brakes comprising a retractable chock 20, one shown, characterized as a laterally extending piece of structural metal angle connected to a link 21 which is hinged to a short support bracket 22 suitably secured on the axle 17. The chocks 20 extend laterally over the track of each wheel 18 and may be pivoted into a position to be wedged between the wheels and the surface on which the apparatus 10 is supported to prevent unwanted movement of the apparatus. Blows delivered to the apparatus will normally be directed in such a way as to tend to move the apparatus to the right viewing FIG. 1.

Referring again to FIGS. 1 and 2, the upstanding frame or mast member 14 is suitably secured at its top end by spaced downwardly extending braces 23 which are each secured at their respective top ends to the cap 16 and at their lower ends to suitable brackets 25, see FIG. 3, which are secured to the axle 17. The lower ends of each of the braces 23 may be provided with a threaded portion for securing the braces to the axle brackets whereby the tension in the braces may be adjusted.

The frame member 12 is preferably characterized as a cylindrical steel drum closed at its opposite ends and including a suitable opening 24 whereby dense material such as water, sand or other suitable fluidlike mass may be poured into the interior chamber 27 of the drum to add weight to the apparatus to minimize the tendency for the apparatus to move in use. As shown in FIGS. 1 and 2, the frame member 12 also includes two spaced apart sleevelike receptacles 29 extending into the interior of the drum and adapted to receive the lower ends of the mast tubes 15 in supportive relationship thereto. Accordingly, it will appreciated from the foregoing description that the frame structure of the apparatus 10 may be easily disassembled to facilitate transportation of the apparatus and, alternatively in conjunction with further description herein, the mast 14 may be used in conjunction with a separate set of stationary support brackets for providing a fixed installation.

Figure 4:
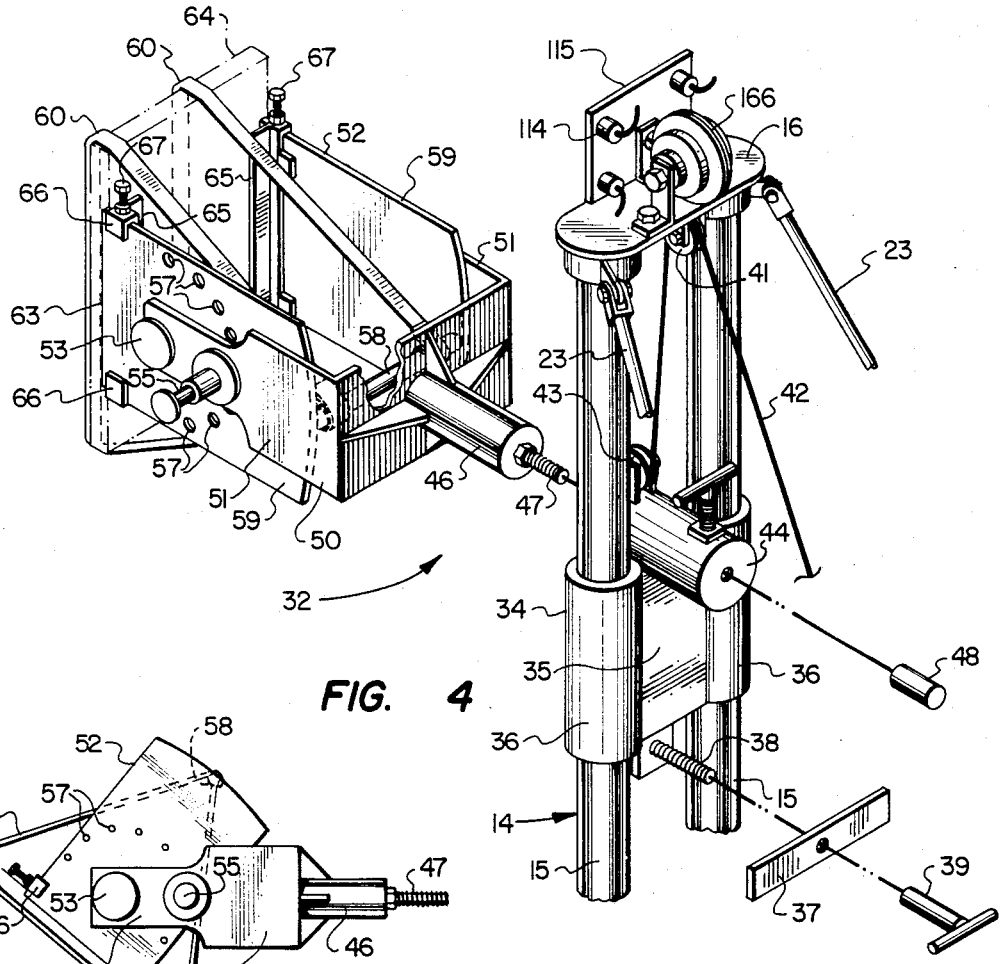
FIG. 4 is an exploded perspective view of the universal support bracket for the apparatus of the present invention.

Referring again to FIGS. 1 and 2 and also to FIG. 4, the apparatus 10 includes a universally positionable bracket, generally designated by the numeral 32, which is adapted to be slidably supported on the mast 14 and located at various predetermined positions on the mast. The bracket 32 includes a vertical traverse support member 34 comprising spaced apart tubular sleeves 36 which are interconnected by a web 35 and are slidably disposed on the mast tubes 15. A suitable clamping mechanism including a jaw member 37, stud member 38 and a locknut 39 is arranged to clamp the traverse member 34 in a predetermined position on the mast 14. The bracket 32, including the traverse member 34, is operable to be raised and lowered by a suitable winch mounted on the frame 12 and generally designated by the numeral 40. The winch 40 includes a drum on which is wound a flexible cable 42 which is trained through a sheave 41 mounted on the cap 16 and downwardly and around a sheave 43 mounted on the traverse member 34 then reversely upwardly and suitably anchored to the cap 16. Accordingly, in moving the universal bracket 32 from one position to another the jaw member 37 is released from gripping engagement with the mast 14 and the winch operated to reposition the bracket as desired.

Figure 5:
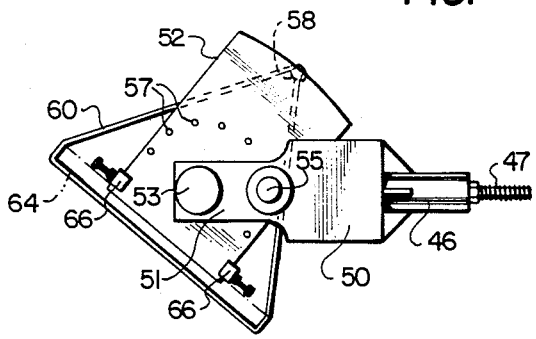
FIG. 5 is a detail side elevation of the bracket shown in FIG. 4.

Referring further to FIG. 4, the vertical traverse member 34 includes a generally horizontally extending tubular part 44 forming a socket for receiving a cylindrical shank portion 46 of the universal bracket 32. The shank 46 includes a threaded distal end part 47 projecting through an end wall of the socket 44 and suitably secured thereto in a preselected rotative position of the shank by a locknut 48. The bracket 32 includes a generally U-shaped member or yoke 50 secured to the shank 46 and adapted to support a second yoke member 52 between opposed legs 51. The second yoke member 52 is pivotally supported on the legs 51 of the yoke member 50 by opposed laterally projecting trunnions 53, one shown in FIG. 4. The yoke member 52 may be selectively positioned about the pivot axis of the trunnions 53 by a spring biased plunger 55 which is adapted to register with a selected one of locating holes 57 formed in one of legs 59 of the yoke member 52 to lock the yoke member in various preselected rotative positions with respect to the yoke member 50 as shown in FIGS. 4 and 5. The base of the yoke member 52 includes a transverse bar 58 to which is secured a pair of elastic retaining straps 60 having suitable hook portions formed thereon or suitably attached thereto.

The distal lateral edges 63 of the legs 59 of yoke member 52 may be suitably wide enough to serve as support for an article 64 to be struck a swift blow by the artisan using the apparatus 10 or, alternatively, a pair of demountable support plates 65 may be attached to the lateral edges of the yoke member 52, as illustrated in FIG. 4. The support plates 65 include opposed channel shaped end portions 66 adapted to slide over opposed sides of the legs 59 and be suitably secured thereto by a set screw 67, for example. Accordingly, as illustrated in FIG. 4, the article 64 may be supported across the span between the opposed legs 59 of the yoke 52 by the support plates 65 and the straps 60. Moreover, the article 64 may be impacted by a hand or foot upon delivering a swift blow to and through the article into the space between the legs of the yoke 52 with minimum risk of injury.

Those skilled in the art will appreciate from the foregoing description, and from viewing FIGS. 4 and 5, that the bracket 32 may be essentially universally positioned to orient the article 64 in a predetermined position for receiving a blow delivered by the hand, foot or other portion of a human appendage. The vertical traverse member 34 may, of course, be winched to a selected vertical position along the mast 14. The yoke 50 may be selectively rotatably positioned about the longitudinal axis of the shank 46 and the yoke 52 may be selectively rotatably positioned about the axis of the trunnions 53. Accordingly, the bracket 32 may be universally positioned about three mutually perpendicular axes.

Figure 6:
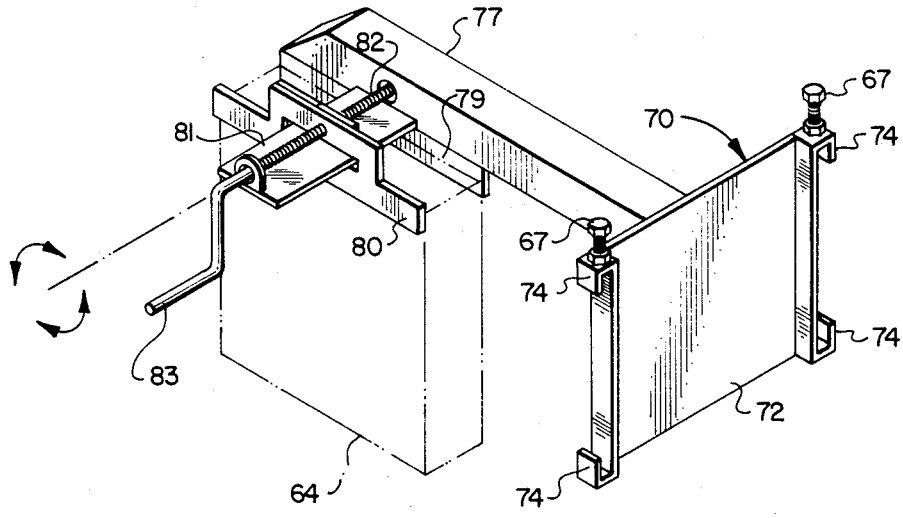
FIG. 6 is a perspective view of one embodiment of a head member for supporting articles to be struck in practicing a defense art.

Referring now to FIG. 6, there is illustrated an alternate embodiment of a supporting head member for supporting articles to be struck a blow by the user of the apparatus 10. The head member illustrated in FIG. 6 is generally designated by the numeral 70 and includes a base plate 72 having opposed channel shaped lugs 74 located at opposite corners of the base plate and dimensioned to slip over the distal ends of the legs 59 of the yoke member 52 in a manner similar to the mounting arrangement for the support plate 65. Two of the channel shaped lugs 74 are provided with a set screw 67 to releasably lock the support member 70 on the yoke 52. The support member 70 includes a cantilever beam portion 77 which projects from the base plate 72 and is suitably welded thereto. The beam 77 includes a vise mounted thereon comprising opposed jaw portions 79 and 80. The jaw 80 is slidably mounted on a laterally projecting slide member 81 which is adapted to support a screw 82 having a crank member 83. The screw 82 is threadedly engaged with jaw member 80 and is adapted to operate in a manner similar to a conventional vise to clamp an article 64 between the jaws 79 and 80. Accordingly, if the head member 70 is mounted on the bracket 32 it may also be selectively positioned for holding an article to be struck at a wide range of predetermined positions for breaking the article or for merely delivering a blow thereto in practicing certain maneuvers in the defense arts.

Figure 9:
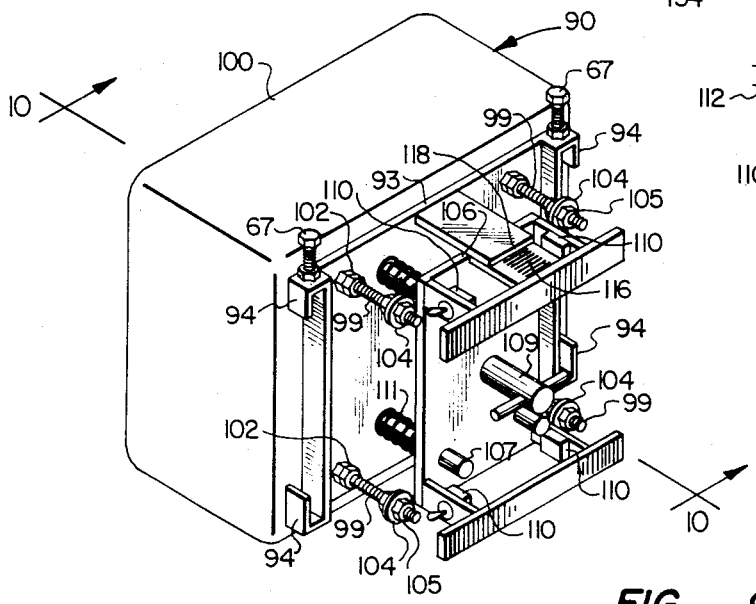
FIG. 9 is a perspective view of still another embodiment of a head member in accordance with the present invention.
Figure 10:
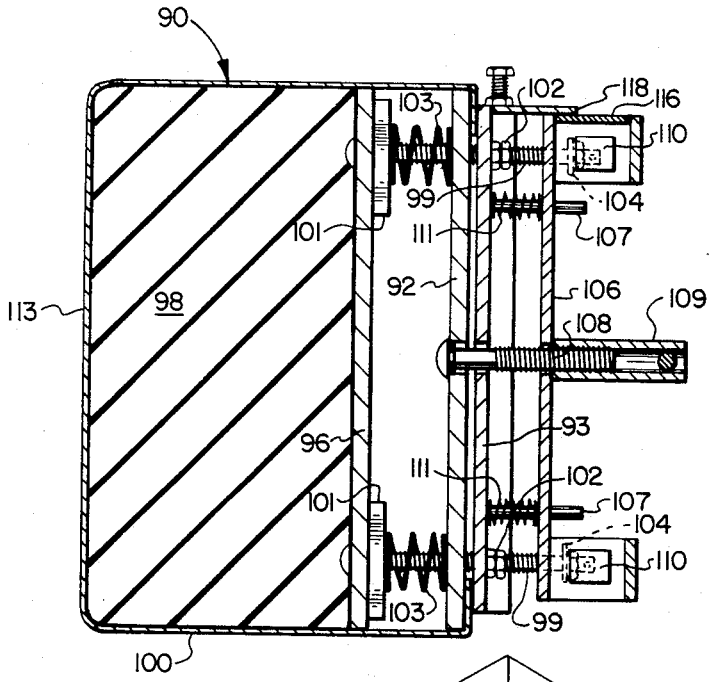
FIG. 10 is a section view taken along the line 10—10 of FIG. 9.

In the art of karate, for example, it is important to develop skill in accurately placing a blow or kick on the intended target and also with sufficient intensity. In this regard, the apparatus of the present invention includes means for measuring the accuracy of the placement of a blow on a target as well as the intensity of the blow. Referring now to FIGS. 9 and 10 there is illustrated a blow measuring head or target member of unique configuration and generally designated by the numeral 90. The target member 90 includes a generally rectangular base member 92 suitably secured to a backing plate 93 on which spaced apart channel shaped lugs 94 are formed and adapted for supporting the member 90 on the opposed leg portions of the yoke 52 in a manner similar to the manner in which the member 70 and the plates 65 are supported. As shown in FIG. 10, the head member 90 includes a second generally rectangular plate member 96 positioned adjacent to and spaced from the plate member 92 and supportive of a blow receiving cushion generally designated by the numeral 98. The cushion 98 as well as the plates 92 and 96 may be enclosed by a suitable flexible fabriclike cover, generally designated by the numeral 100. The plate 96 is secured to the plate 92 by four elongated pins comprising threaded bolts 99 which are spaced apart in a rectangular pattern and which project through respective clearance holes in the plates 92 and 93. Each of the bolts 99 has a coil spring 103 disposed therearound and between adjacent faces of the plates 92 and 96 as shown by way of example in FIG. 10. One or both of the plates 92 and 96 may be provided with suitable pads 101 forming counterbored recesses for receiving the ends of the coil springs 103 to maintain the springs generally centered about the respective bolts 99. Each of the bolts 99 is provided with a double locknut 102 which is threaded over the end of the bolt and adjusted to a predetermined deflection of the springs 103 which are trapped between the plates 92 and 96. The distal ends of the bolts 99 also include adjustable trigger elements disposed thereon comprising circular washers 104 which are adapted to be adjustably positioned along the bolts 99 by locknuts 105.

The backing plate 93 is adapted to support a generally rectangular frame member 106 by four spaced apart guide pins 107, two shown in FIG. 10, which project through clearance bores in the frame member and in a direction generally parallel to the bolts 99. A threaded bolt 108 also projects from the center of the plate assembly 92–93, through a clearance hole in the frame member 106 and is threadedly engaged with an adjustable locknut 109 which is engaged with the frame member. Coil springs 111 are disposed around each of the guide pins 107 and are trapped between the plate 93 and the frame member 106 and thereby bias the frame member against the locknut 109. The frame member 106 is adapted to support four spaced apart toggle type switches 110 which are positioned to be engaged by the respective triggers 104 in response to movement of the plate 96 with respect to the plates 92-93. Each of the bolts 99 is suitably fixed to the plate 96 for movement therewith in response to an impact blow being delivered to the target face 113 of the head member 90.

Figure 9A:
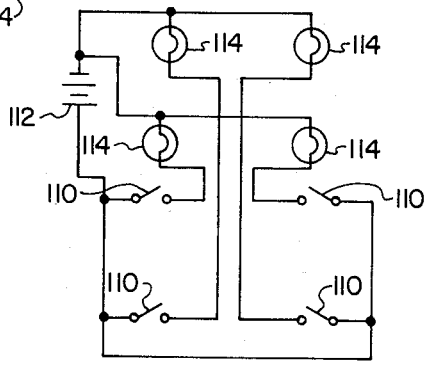
FIG. 9A is a schematic diagram of the target indicator circuit for the head member of FIG. 9.

Referring also to FIG. 9A, there is illustrated a circuit diagram, including the switches 110, which is adapted to be connected to an electrical source which may comprise a battery 112 suitably mounted on the apparatus 10 or by way of suitable leads to a remote source such as a wall socket. The switches 110 may be of a type which remain closed when actuated until reset. The switches 110 are in circuit with respective visual indicator lights 114. The indicator lights 114 are preferably arranged in a rectangular pattern on a support plate 115 mounted on the cap 16, as shown in FIG. 4. Accordingly, in response to deflection of the plate 96, upon the delivery of an impact blow to the cushion 98, one or more of the bolts 99 will move sufficiently to cause its trigger 104 to actuate the associated switch 110 thereby turning on the associated indicator light 114. If a blow is delivered to the face 113 of the cushion substantially centered with respect to the pattern of the bolts 99, and with sufficient intensity, all four switches 110 may be actuated thereby energizing all four indicators 114 to indicate that a blow has been delivered accurately and with sufficient intensity to the center of the target. If the blow is delivered somewhat off center with respect to the bolt pattern the plate 96 may be deflected angularly with respect to the plate 92 and one or more of the switches 110 will be actuated to indicate the general location of the point of delivery of the blow with respect to the center of the target face 113.

The intensity of a blow which must be delivered to actuate the switches 110 may be adjusted by adjusting the position of the triggers 104 on the bolts 99 or by adjusting the position of the frame member 106 with respect to the triggers. The frame member 106 may be adjusted by the locknut 109 to move the frame member with respect to the plate 93. In any case, the force required to deflect the springs 102 sufficiently to permit actuation of the switches 110 may be adjusted by either or both of the above described techniques and preferably is adjusted by positioning the frame member 106. In this respect the position of the frame member 106 with respect to the backing plate 93 may be measured and suitable indicia may be provided on a surface 116, FIG. 9, on the frame member 106 which may be moved relative to a reference surface 118 formed on a member secured to the plate 93. By moving the frame member 106 toward the plate 93, for example, the actuating levers of the switches 110 are positioned closer to the triggers 104 and the force of the blow required to energize the indicators 112 is relatively reduced as compared with positioning the triggers farther from the switch levers. As previously mentioned the switches 10 may be of any suitable type such as a positive throw toggle lever type switch requiring manual reset. Other types of switches and additional circuitry might be utilized in place of the circuitry described wherein the indicator lights would remain on once the switches were actuated and could be reset by separate circuit means.

Accordingly, the head member 90 provides improved means for measuring the accuracy of the placement of a blow as well as the intensity of the blow delivered by the artisan. By adapting the member 90 to be used particularly in conjunction with the universal bracket 32 one practicing a defense art such as karate may hone his skill at accurately placing a blow as well as gauging the intensity thereof.

Figure 7:
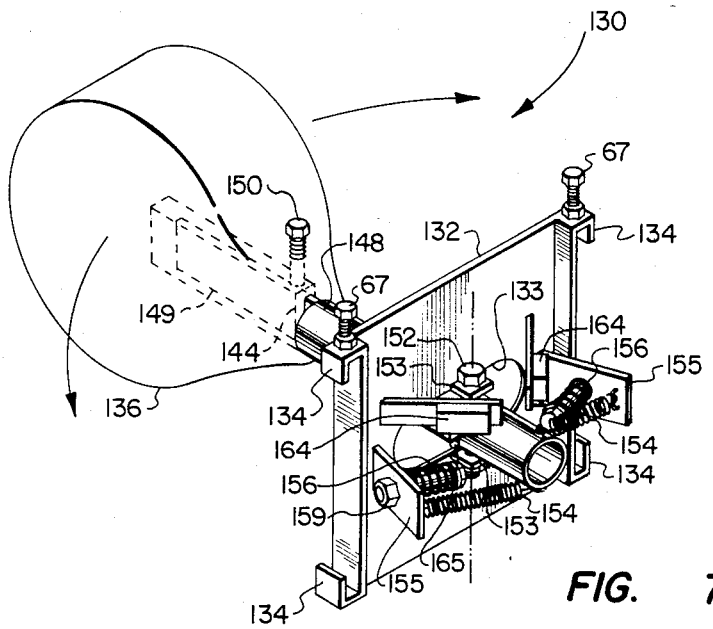
FIG. 7 is a perspective view of another embodiment of a head member which may be detachably mounted on the support bracket.
Figure 8:
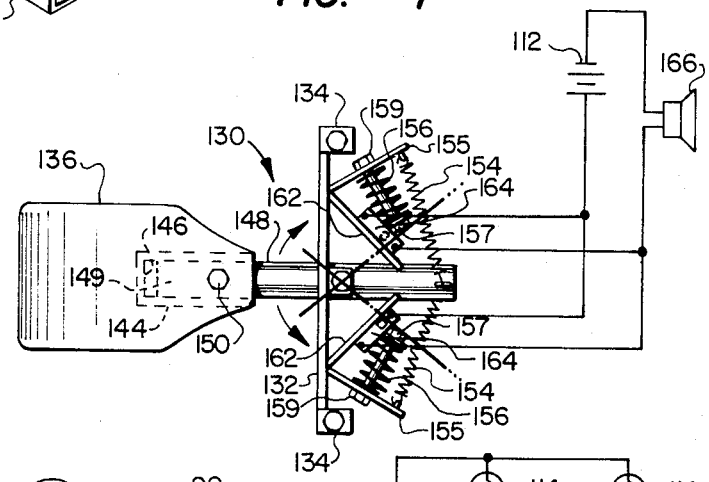
FIG. 8 is a plan view of the head member of FIG. 7.

Referring now to FIGS. 7 and 8, there is illustrated another embodiment of a target or head member for the apparatus 10 and which is generally designated by the numeral 130. The head member 130 includes a support plate 132 having spaced apart channel shaped lug members 134 arranged as per the arrangement of the member 90, for example, and adapted for mounting the member 130 on the opposed legs of the yoke member 52. Two of the opposed lugs 134 include set screws 67 in a manner similar to the lugs 66 and 94. The head member 130 includes a target, generally designated by the numeral 136, comprising a cushioned pad covered by a suitable flexible fabric covering similar to the target of the head member 90. The target 136 includes a generally rectangular shaped tubular support member 144 having a recess 146 therein which is adapted to be mounted in sleeved relationship over the distal end of a support arm 148 having a cooperating shank portion 149 adapted to be telescopically inserted in the member 144. A suitable locking set screw or the like 150 is threadedly mounted on the member 144 and is engageable with the cooperating shank portion of the arm 148 whereby the position of the target 136 may be adjusted and locked in a predetermined location with respect to the support arm.

The arm 148 projects through a recess 133 formed in the plate and is pivotally mounted on a pivot pin 152, comprising an elongated bolt, which is supported by spaced apart lugs 153 on the support plate 132. The end of the arm 148 opposite the target 136 is connected to opposed tension coil springs 154 which are connected respectively at one end to the arm and lead generally in opposite directions whereby their opposite ends are connected to suitable support brackets 155 mounted opposite each other on the plate 132, as illustrated. The support brackets 155 also are adapted to support opposed resilient bumper members, each generally designated by the numeral 156, and comprising elongated bolts having coil springs disposed therearound and trapped between the head 157 of the bolt and a side surface of the support bracket 155. The aforementioned bolts project through the brackets 155 and are held in assembled relationship therewith by adjustable locknuts 159.

The head 130 also includes sensing means mounted in proximity to the target shank 148 for signaling suitable deflection of the target. The support plate 132 includes opposed brackets 162 each of which is adapted to support a switch 164 having a cam type actuator 165, as shown by way of example in FIG. 7. The switches 164 are adapted to be adjustably positioned on the brackets 162 for engagement by the arm 148 in response to a swinging movement thereof toward one or the other of the bumpers 156. The switches 164 are suitably arranged in circuit with an audible signaling device such as a horn 166 as illustrated by the circuit diagram in FIG. 8. The horn 166 is also suitably connected to an electrical source such as the aforementioned battery 112. Accordingly, in respone to delivering a blow to the target 136 the shank member 148 will be pivoted about the axis of the pivot pin 152 to engage one or the other of the switches 164 to produce a signal indicating sufficient intensity of the blow delivered to the target. The blow intensity required to produce a signal may be adjusted by adjusting the position of the target member 136 on the shank 149 to vary the moment arm length of the arm 148, by adjusting the deflection of the bumpers 152, and adjusting the position of the switches 164 with respect to their associated support brackets. The springs 154 are formed to have a force-deflection characteristic suitable only to primarily return the arm 148 to a generally centered position with its longitudinal axis projecting perpendicular to the plate 132. As with the head member 90, the head member 130, when mounted on the bracket 132, may be positioned in a wide range of target positions for being struck a blow to the target member 136. The head member 130 is, however, particularly adapted for receiving spin kicks or the like when practicing the art of karate.

Figure 11:
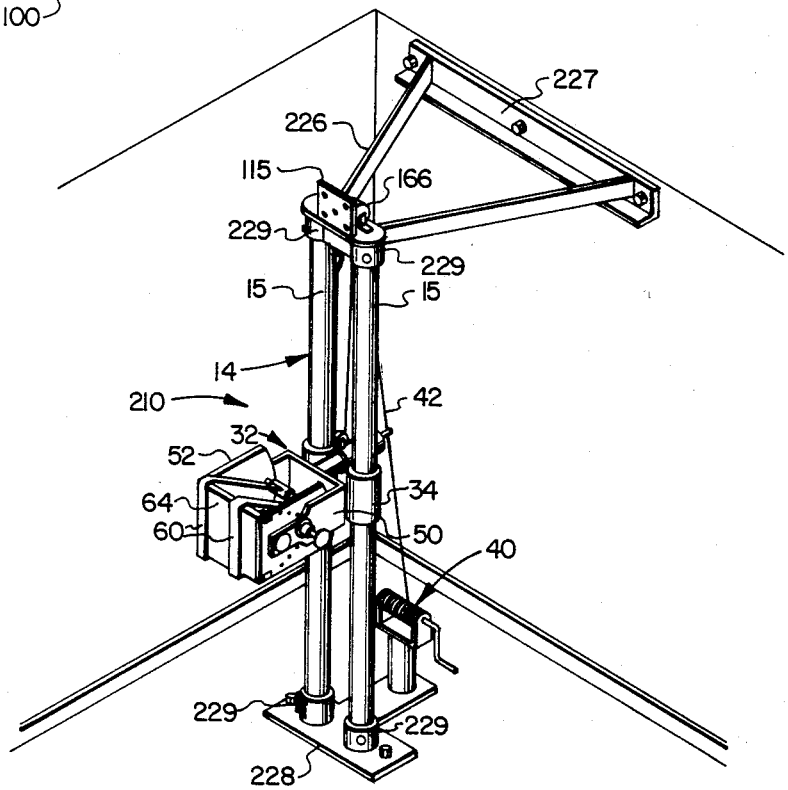
FIG. 11 is a detail view of a stationary version of the apparatus of the present invention.

Referring now to FIG. 11, there is illustrated an alternate embodiment of the apparatus, generally designated by the numeral 210, wherein the mast tubes 15 are supported by spaced apart brackets 226 and 228. The brackets 226 and 228 each have short sleevelike receptacle portions 229 suitably spaced apart to coincide with spacing of the mast tubes as supported by the cap 16 and the drum receptacles 29 in the embodiment of FIG. 1. The bracket 226 includes a base member 227 which may be suitably secured to a vertical wall, as illustrated in FIG. 11, and the bracket 228 is adapted to be secured the floor in alignment with the sleeve receptacles of the bracket 226. The winch 40 is preferably mounted on a pedestal 233 secured to the bracket 228.

Those skilled in the art of apparatus of the general type described herein will appreciate that various substitutions and modifications may be made to the specific embodiments disclosed without departing from the scope and spirit of the invention as recited in the appended claims.

What I claim is:

1. Apparatus for practicing a defense art of striking a swift blow with an appendage such as a hand or foot and comprising:

a support frame including a portion comprising generally vertically upstanding mast means; and universal bracket means mounted on said mast means and adapted to be adjustably positioned on said mast means, said bracket means including a traverse member mounted on said mast means and including means for selectively securing said bracket means to said mast means at a predetermined vertical position thereon, a first yoke member adapted to be selectively rotatably positioned on said traverse member about a first generally horizontal axis, means for locking said first yoke member in a predetermined position on said traverse member, a second yoke member mounted on said first yoke member and rotatable about an axis generally perpendicular to said first axis and the longitudinal axis of said mast means, and means for releasably locking said second yoke member with respect to said first yoke member, said second yoke member including opposed arms and means for supporting an article in such a way that said article may be broken by striking a blow through said article between said arms of said second yoke member.

2. The apparatus set forth in claim 1 wherein:

said frame includes a frame member supporting said mast means, said frame member being adapted to receive additional mass for stabilizing said frame.

3. The apparatus set forth in claim 2 wherein:

said frame member includes a container for receiving dense fill material comprising said additional mass.

4. The apparatus set forth in claim 2 wherein:

said frame includes an axle, spaced apart wheel means mounted on said axle, and a support foot mounted on said frame spaced from said axle.

5. The apparatus set forth in claim 1 wherein:

said mast means includes at least one elongated tubular member, said frame includes means forming a receptacle for receiving a lower portion of said tubular member, and said frame includes a pair of spaced apart braces connected respectively at one end to an upper end of said mast means and at respective lower ends to said frame at points spaced apart from each other.

6. The apparatus set forth in claim 1 wherein:

said mast means comprises at least one elongated tubular member and spaced apart bracket means including, respectively, a first member adapted to be secured to a vertical wall and having means for receiving and supporting one end of said one tubular member, and a second member adapted to be secured to a floor surface and having means for receiving and supporting the opposite end of said tubular member.

7. Apparatus for practicing a defense art of striking a swift blow with an appendage such as a hand or foot and comprising:

a support frame including a portion comprising generally vertically upstanding mast means; and universal bracket means mounted on said mast means and adapted to be adjustably positioned on said mast means, said bracket means including a vertical traverse member mounted on said mast means and including means for selectively securing said bracket means to said mast means at a predetermined vertical position thereon, means forming a first yoke member having a base portion adapted to be selectively rotatably positioned on said traverse member about a first generally horizontal axis, and including means for locking said first yoke member in a predetermined position on said traverse member, a second yoke member mounted on said first yoke member and rotatable about an axis perpendicular to said first axis and the longitudinal axis of said mast means, and including means for releasably locking said second yoke member in a predetermined position with respect to said first yoke member, and means for supporting an article to be dealt a blow by a hand or foot wherein said article is supported for receiving said blow directly, said means for supporting said article including a member removably supportable on said second yoke member by cooperable fastener means.

8. The apparatus set forth in claim 1 wherein:

said bracket means is adapted to provide a clear span between opposed arms of said second yoke member for supporting an article to be broken by striking a blow through said article between said arms of said second yoke member.

9. The apparatus set forth in claim 1 including:

a head member adapted to mount on said second yoke member, said head member including a support plate adapted to be detachably mounted on said second yoke member, a support beam extending from said support plate, and releasable clamp means disposed on said support beam for clamping an article to said beam to provide a clear area on the side of said article opposite the side which is to be struck.

10. The apparatus set forth in claim 1 including:

a head member adapted to mount on said second yoke member, said head member including means forming a first support plate including means for securing said first support plate to said second yoke member, a second support plate including means forming a target disposed thereon, said second support plate being spaced from and supported on said first support plate by means including resilient means whereby said second support plate is movable relative to said first support plate in response to a blow being delivered to said target, and means associated with said second support plate and responsive to deflection of said second support plate relative to said first support plate to indicate a blow being struck against said target.

11. The apparatus set forth in claim 10 wherein:

said means supporting said second support plate includes a plurality of spaced apart pin means projecting from said second support plate through said first support plate, said resilient means include mechanical spring means interposed between said support plates and operable to bias said support plates away from each other, and said indicator means includes an electrical circuit including a plurality of switches, visual indicators in circuit with respective ones of said switches, each of said switches being adapted to be actuated to effect a change of state of its associated indicator in response to deflection of said second support plate to indicate the relative position of contact of a blow against said target.

12. The apparatus set forth in claim 11 wherein:

respective ones of said switches are disposed in proximity to and engageable by respective trigger means disposed on said pin means, and said switches are operable to energize said indicators in response to deflection of respective ones of said pin means to indicate the relative location of a blow against said target.

13. The apparatus set forth in claim 12 wherein:

said head member includes means for selectively positioning said switches with respect to said trigger means whereby the intensity of a blow applied to said target sufficient to effect a change of state of said indicator means may be varied in accordance with the amount of deflection of said second support plate with respect to said first support plate.

14. The apparatus set forth in claim 13 wherein:

said means for positioning said switches includes a support member for said switches mounted on and movable with respect to said first support plate, means for biasing said switch support member away from said first support plate and cooperating screw and nut means interconnecting said switch support member and said first support plate for selectively positioning all of said switches simultaneously through movement of said switch support member relative to said first support plate.

15. The apparatus set forth in claim 11 wherein:

said spring means comprise individual coil springs disposed around respective ones of said pins between said first and second support plates.

16. The apparatus set forth in claim 1 including:

a head member adapted to mount on said second yoke member, said head member including a support member, an arm pivotally connected to said support member and adapted to support a target member on a distal end portion of said arm spaced from the pivot axis of said arm, indicator means associated with said arm and responsive to a pivotal swinging movement of said arm for indicating movement of said arm in response to a blow being struck against said target member.

17. The apparatus set forth in claim 16 wherein:

said target member includes means for selectively positioning said target member on said arm at a predetermined position with respect to said pivot axis to vary the effective moment arm of a blow applied to said target member.

18. The apparatus set forth in claim 16 including:

opposed resilient bumper means mounted on said support member and engageable with said arm in response to the pivotal movement thereof to limit said pivotal movement.

19. Apparatus for practicing a defense art of striking a swift blow with an appendage such as a hand or foot and comprising:

a support frame including a portion comprising a generally vertically upstanding mast;

a universal bracket mounted on said mast and adapted to be adjustably positioned on said mast, said bracket including means adjustable about at least two mutually perpendicular axes for supporting a target to be dealt a blow by a hand or foot;

said target being disposed on a head member supported on said bracket, said head member including means forming a first support member including means for securing said first support member to said bracket, a second support member including means forming said target disposed thereon, said second support member being spaced from and supported on said first support member by means including resilient means whereby said second support member is movable relative to said first support member in response to a blow being delivered to said target, and means associated with said second support member and responsive to deflection of said second support member relative to said first support member to indicate a blow being struck against said target, said indicator means including trigger means spaced apart on said second support member in a predetermined pattern, an electrical circuit including a plurality of switches, visual indicators in circuit with respective ones of said switches, each of said switches being adapted to be actuated by a respective one of said trigger means to effect a change of state of said associated indicator in response to deflection of said second support member to indicate the relative position of a blow against said target.

* * * * *